US008340844B2

(12) United States Patent
Scoca et al.

(10) Patent No.: US 8,340,844 B2
(45) Date of Patent: Dec. 25, 2012

(54) UNDERSEA POSITION AND VELOCITY MEASURING SYSTEM AND PROCESS

(75) Inventors: Anthony Scoca, Mitchel Field, NY (US); Mike Hanczor, Mitchel Field, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 1017 days.

(21) Appl. No.: 12/244,418

(22) Filed: Oct. 2, 2008

(65) Prior Publication Data

US 2010/0049436 A1 Feb. 25, 2010

Related U.S. Application Data

(60) Provisional application No. 61/090,406, filed on Aug. 20, 2008.

(51) Int. Cl.

| | |
|---|---|
| ***B63G 8/00*** | (2006.01) |
| ***B63G 8/38*** | (2006.01) |
| ***B63B 22/00*** | (2006.01) |
| ***B63B 22/20*** | (2006.01) |
| ***G08G 3/00*** | (2006.01) |
| ***G01C 21/00*** | (2006.01) |
| ***G01C 21/20*** | (2006.01) |
| ***G01S 19/00*** | (2010.01) |

(52) U.S. Cl. ..... 701/21; 701/412; 701/469; 340/995.25; 340/850; 441/1; 441/29; 114/328; 114/330

(58) Field of Classification Search ..... 701/1, 21, 701/36, 49, 200, 207, 213, 300, 400, 408, 701/412, 468, 469, 470, 520, 538, 409, 445; 340/901, 984, 988, 989, 990, 995.25, 995.28, 340/850, 851; 441/1, 2, 3, 6, 7, 11, 21, 23, 441/25, 26, 28, 29; 114/326, 328, 333
See application file for complete search history.

(56) References Cited

U.S. PATENT DOCUMENTS

| | | | |
|---|---|---|---|
| 3,599,213 | A | 8/1971 | Fessenden et al. |
| 4,443,698 | A | 4/1984 | Schiffner |
| 4,962,488 | A | 10/1990 | Dell-Imagine et al. |
| 5,119,341 | A | 6/1992 | Youngberg |
| 5,319,376 | A | 6/1994 | Eninger |
| 5,563,967 | A | 10/1996 | Haake |

(Continued)

OTHER PUBLICATIONS

R. Thorne, "Determination of SSBN ownship ground velocity", Navy SBIR 2008.2, Topic N08-200, 2 pages.

*Primary Examiner* — Thomas Tarcza
*Assistant Examiner* — Edward Pipala
(74) *Attorney, Agent, or Firm* — Howard IP Law Group, PC

(57) ABSTRACT

This invention relates to a GPS navigation system comprised of a submerged vessel having a navigation processor associated via buoyant cable with a buoy having a GPS device; wherein the cable contains: a data link between the vessel and the GPS device; and a location device for the determination of the location of the cable to the vessel; and wherein the processor computes a GPS position relative to the vessel. The invention also relates to a navigation process comprising the steps of: attaching a cable between a buoy and a submerged vessel; providing a GPS data relative to the buoy and cable location data over the cable to the submerged vessel; and using the GPS position of the buoy and location data to compute the GPS position of the submerged vessel.

32 Claims, 5 Drawing Sheets

U.S. PATENT DOCUMENTS

| | | | | |
|---|---|---|---|---|
| 5,579,285 | A | 11/1996 | Hubert | |
| 5,748,102 | A * | 5/1998 | Barron | 340/850 |
| 5,798,521 | A | 8/1998 | Froggatt | |
| 6,056,237 | A | 5/2000 | Woodland | |
| 6,301,420 | B1 | 10/2001 | Greenaway et al. | |
| 6,701,252 | B2 | 3/2004 | Brown | |
| 6,856,400 | B1 | 2/2005 | Froggatt | |
| 6,888,623 | B2 | 5/2005 | Clements | |
| 6,950,075 | B1 | 9/2005 | Rivera | |
| 6,961,657 | B1 | 11/2005 | Wernli et al. | |
| 7,226,328 | B1 | 6/2007 | Puzella et al. | |
| 7,289,906 | B2 | 10/2007 | van der Merwe et al. | |
| 7,411,558 | B1 * | 8/2008 | Pickreign et al. | 343/709 |
| 2003/0135326 | A1 | 7/2003 | Brown | |
| 2005/0159891 | A1 | 7/2005 | Cohen et al. | |
| 2005/0219512 | A1 | 10/2005 | Froggatt et al. | |
| 2006/0071851 | A1 | 4/2006 | Graas et al. | |
| 2006/0178829 | A1 | 8/2006 | Gaiffe | |
| 2007/0065077 | A1 | 3/2007 | Childers et al. | |

* cited by examiner

UNDERSEA POSITION AND VELOCITY MEASURING SYSTEM AND PROCESS

RELATED APPLICATION

This application claims priority of U.S. Patent Application Ser. No. 61/090,406, entitled Undersea Position and Velocity Measuring System and Process, filed Aug. 20, 2008, the entire disclosure of which is hereby incorporated by reference.

FIELD OF INVENTION

The present invention relates to a high accuracy non-acoustic covert means to provide ships navigation information to a submerged vessel.

BACKGROUND OF THE INVENTION

There is need for reliable, high accuracy covert means to provide navigation and surveillance information to and/or from submerged vessels such as submarines. To this end, high accuracy navigation information including position, velocity and time data, for example, is made available to submerged vehicles via a global positioning system (GPS) antenna. It is understood that the term GPS refers to any navigational system involving satellites and computers for determining the latitude and longitude of a receiver on Earth by computing the time difference for signals from different satellites to reach the receiver (examples are GPS, GLONASS and Galileo). These antennas need to operate out of water and therefore require the submerged vessels to approach the surface to extend an antenna. This however, compromises the aim of remaining covert. There exist acoustic means for obtaining certain navigation data without requiring submerged vessels to approach the surface and extend an antenna from the waters. Such devices involve the use of velocity measuring sonar and velocity integration and/or bathymetric position fixing. However, the use of sonar itself may compromise covertness. In any case, neither approach is as accurate as GPS and further does not provide time data as does GPS.

A system that reduces submarine vulnerability employs a GPS antenna extended to the ocean surface via coaxial cable to an external buoy. This point-to-point approach will provide navigation data in a covert manner; however, this approach does not yield accurate position and velocity information because the cable's lever arm does not accurately determine the distance between the antenna and the vessel. When the cable extending between the submerged vessel and the buoy antenna is taut, an estimate may be made based upon the length of the taut cable. On the other hand, when the cable connecting the submerged vessel and the extended buoy antenna drifts, as it might for a relatively stationary vessel, the location of the buoy relative to the submerged vessel is unknown.

One solution for determining the actual position of a submerged vessel relative to an associated surface object is to employ a device that determines a cable's shape. For example, so-called smart fibers can aide in measuring topological parameters that represent discrete position coordinates (x, y and z) along the length of a fiber optic bundle. For example, FIG. 1 shows a prior art device 116 such as a smart fiber bundle connection which aides in the measurement of the distance between object 120 (such as a buoy) and object 110 (such as a submerged vessel). The system uses the discrete physical coordinates in a three-axis coordinate system 117 along its length. These devices are presently used in various applications such as ocean surveillance, towing sonar arrays, and tracking search and rescue robots. Although these devices may effectively incorporate smart fibers in shape-sensing technologies, they suffer from a lack of effective means for ascertaining the location of the buoy relative to the submerged vessel.

Shape sensing optical fiber systems compute the bend of the fibers in a three-axis space at every discrete point along their length. Determining the total length in such systems requires a computation to take into account the various bends along the length of the device. For example, Clements (U.S. Pat. No. 6,888,623 B2) describes a fiber optic sensor for precision 3-D position measurement that includes a flexible "smart cable" that enables accurate measurement of local curvature and torsion along its length. Greenaway et al. (U.S. Pat. No. 6,301,420 B1) describes a device having two or more core regions, each core region comprising a transparent core material with a core refractive index, a core length, and a core diameter. The cladding region and the core regions may be arranged such that a laser input to the optical fiber propagates along one or more of the lengths of the core regions in a single mode of propagation. The measurement of the relative shift in the fringe pattern provides an indication of the extent by which the fiber is bent, which can be used to determine a straight line distance between two objects, each tethered to opposite ends of the device (i.e., cable). Schiffner (U.S. Pat. No. 4,443,698) describes a sensing device having a sensing element in the form of an optical fiber, a device for coupling light into the fiber and a device for measuring changes in the specific physical parameters of the light passing through the fiber, to determine special physical influences applied to the fiber and through additional processing measures a distance between two objects, each tethered to opposite ends of the device. Haake (U.S. Pat. No. 5,563,967) and Froggatt (U.S. Pat. No. 5,798,521) through additional processing also measure a distance between two objects, each tethered to opposite ends of a fiber device. Childers (US. Pub. 20070065077) employs a fiber optic position and shape sensing device using at least two single core optical fibers where the strain on the optical fiber is measured and correlated to local bend measurements to determine the position or shape of the optical fibers.

SUMMARY OF THE INVENTION

This invention relates to a GPS navigation system comprising: a submerged vessel having thereon a navigation processor associated via a buoyant cable with a buoy having thereon a GPS device; said cable containing (a) a data link between the vessel and the GPS device for communicating GPS data to the processor and (b) a location device for aiding in the determination of the location of the cable to the submerged vessel; and wherein the processor computes a GPS position relative to the submerged vessel based on the received GPS data and the location device data.

More generally, this invention relates to any covert GPS navigation system comprising: any submerged object in communication with a surface (i.e., unsubmerged) object; a GPS device mounted on the surface object; a buoyant cable containing therein a location device capable of aiding in the determination of the position of the submerged object relative to the surface object, wherein a GPS position of the surface object as determined by the GPS device is communicated to the submerged object, and wherein a processor computes the position of the submerged object relative to the GPS employing the device for aiding the determination of the position of the submerged vessel relative to the surface object.

In yet another embodiment, a buoyant communication transmission cable and a physically linked device for measuring the distance between the two objects are physically integrated into one sheath.

In yet another embodiment, the buoyant communication transmission cable and a physically linked device for measuring the distance between the two objects are electronically integrated into one communication transmission line.

The invention herein also includes a navigation process comprising the steps of: (1) attaching a cable between a buoy and a submerged vessel; (2) providing GPS data relative to the buoy and cable location data over the cable to the submerged vessel; and (3) using the GPS position of the buoy and location data to compute the GPS position of the submerged vessel.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts and.

DETAILED DESCRIPTION OF THE PREFERRED EMBODIMENTS

The following description of the preferred embodiments is merely by way of example and is not intended to limit the invention or its application.

Figure 1:
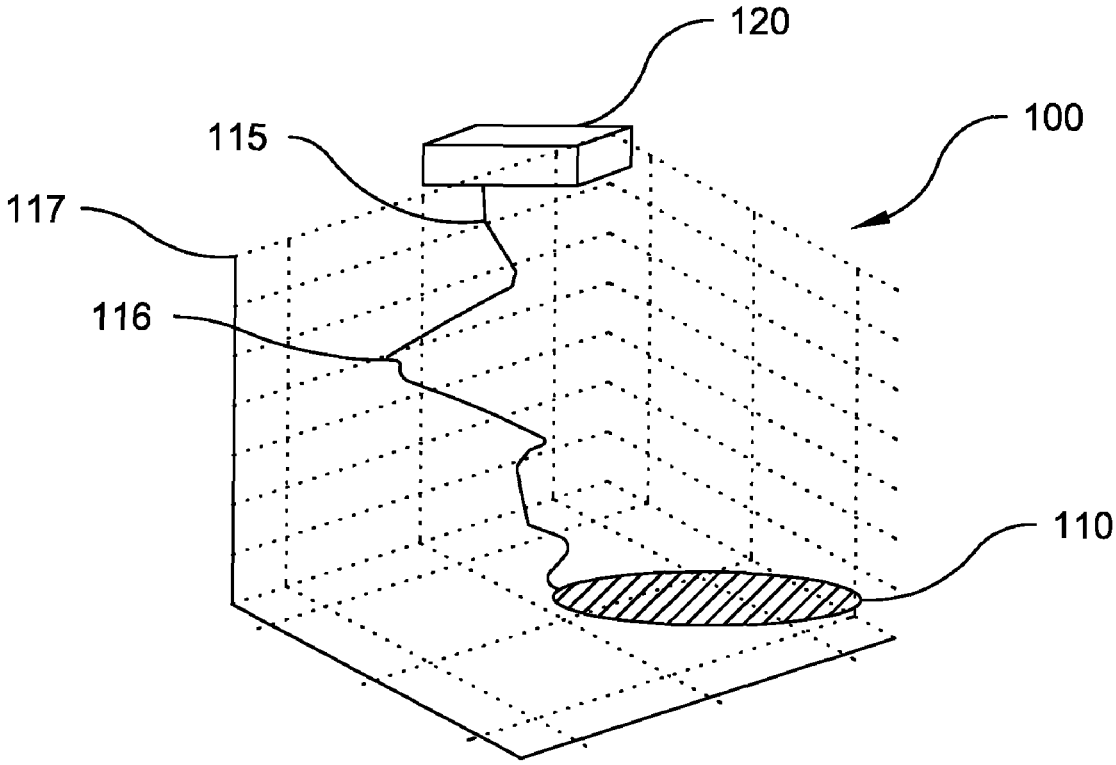
Fig. 1 (Prior Art)
FIG. 1 illustrates a perspective view of a means to provide navigation information to a submerged vessel according to the prior art.
Figure 2:
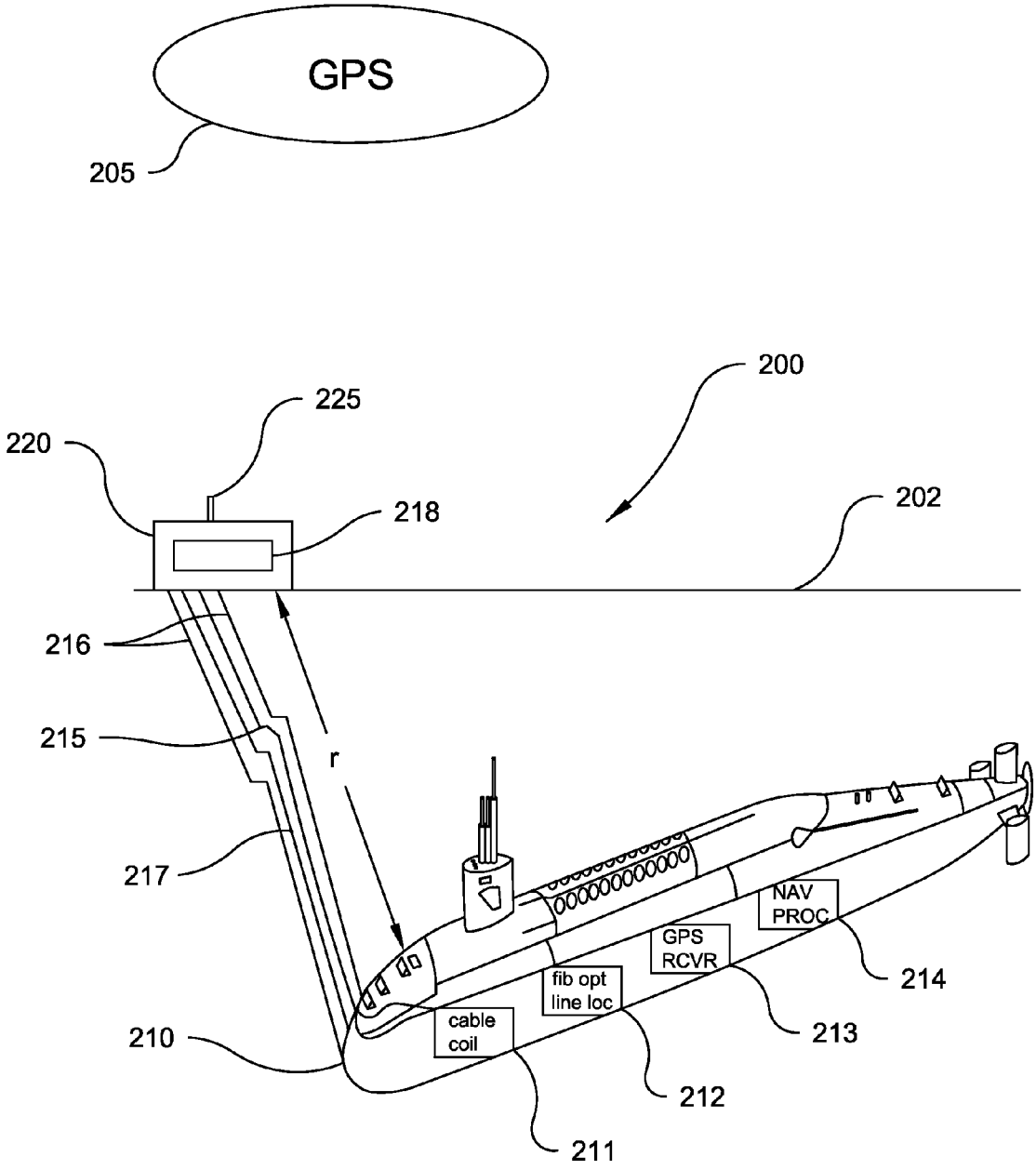
FIG. 2 illustrates a perspective view of a non-acoustic covert means to provide ships navigation information to a submerged vessel according to an embodiment of the invention.

With reference to FIG. 2, an embodiment of the invention includes a navigation reference system 200 comprising: a submerged vessel 210 having thereon a navigation processor 214; a buoy 220 having thereon a GPS device 218; a cable 216 that couples the navigation processor 214 with the buoy 220; wherein the cable 216 contains (a) a data link 217 between the vessel 210 and the GPS device 218 for communicating GPS data to the processor 214 and (b) a location device 215 for aiding in the determination of the location of the cable to the vessel 210; and wherein the processor 214 computes a GPS position relative to the vessel based on the received GPS data and the location device 215 data.

System 200 that utilizes GPS data or other such satellite positioning data via GPS (labeled generally as 205) to accurately determine the position of vessel 210 in accordance. Buoy 220 on the surface of a body of water 202 has contained therein the GPS device 218 and an associated antenna 225 that exploits location measurement device 215 embodied by way of example and not limitation in a so-called smart fiber flexible cable that measures a set of discrete physical coordinates ($x_{(i)}$, $y_{(i)}$ and $z_{(i)}$) along a continuum "i" of its length as situated within a volume of water 202 such that the discrete physical coordinates can be employed to compute an overall distance $r=(x^2+y^2+z^2)^{1/2}$ between the vessel 210 and buoy 220 situated at the distal and proximal ends, respectively, of the location device cable 215. The buoy 220 may be any apparatus that essentially floats in water, as by way of example a conventional buoy or a sea worthy craft (e.g., boat, platform, raft or inflatable device). Although this specification discloses the buoy as a surface vessel attached to a submerged vessel such as a submarine, the buoy as specified herein under the control of the submerged vessel may also have the capability to submerge (e.g., subsurface activity) or maneuver as an amphibious vehicle on land.

In FIG. 2, location device 215 aides in the determination of the position of the tether cable 216 relative to the submerged vessel 210 and the buoy 220. In one embodiment, the entire length of the location device 215 is contained within and is of the same length as cable 216. Cable 216 also contains a conductive wire and/or a fiber optic transmission line 217 that sends GPS position data as acquired from GPS device 218 to a GPS receiver 213 within the submerged vessel. Location device processor 212 receives the data from measuring device 215 to provide location data to a navigation processor 214. The navigation processor 214 using data from the location device processor 212 and the GPS receiver 213 computes the position and the velocity of the submerged vessel 210 relative to one or more GPS positions 205 reported via GPS device 218. A deployment and retraction system 211 permits the coiling and uncoiling of the cable 216.

Figure 3A:
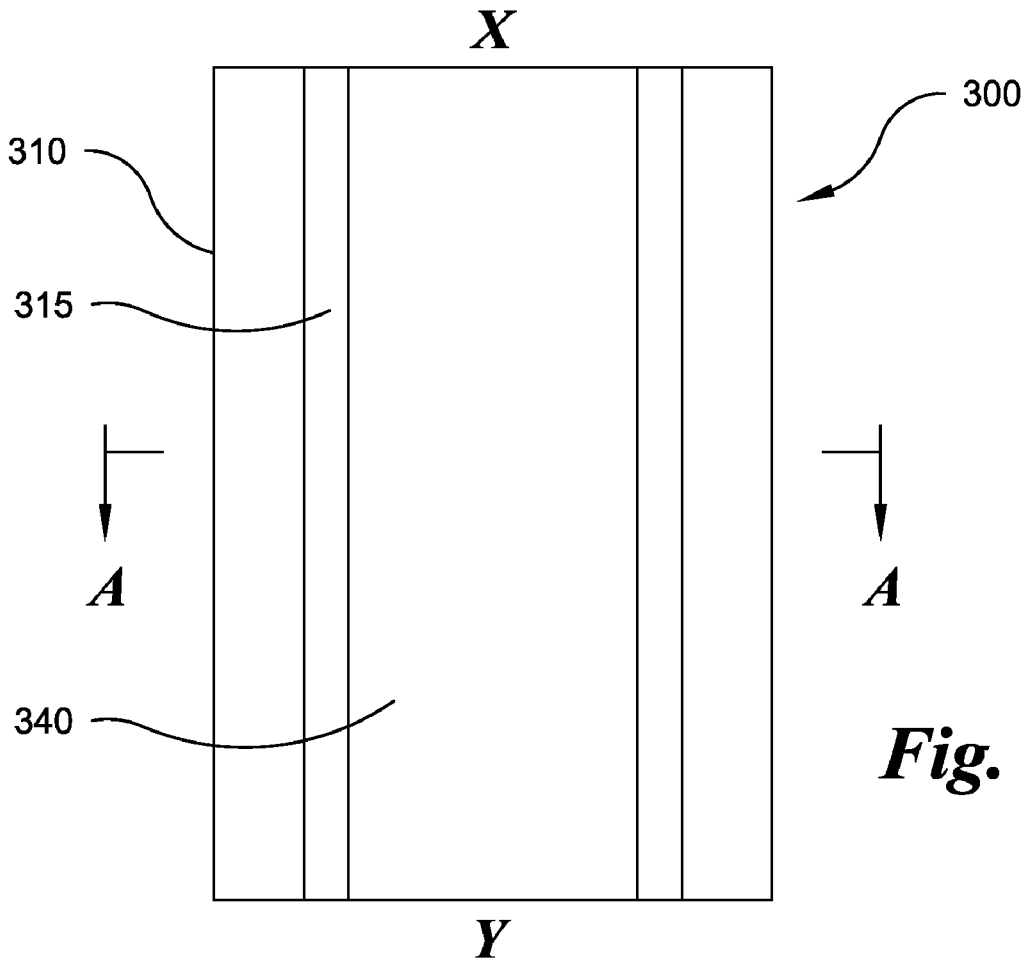
FIG. 3*a* illustrates a plan view of a cross section of a buoyant cable according to an embodiment of the invention.
Figure 3B:
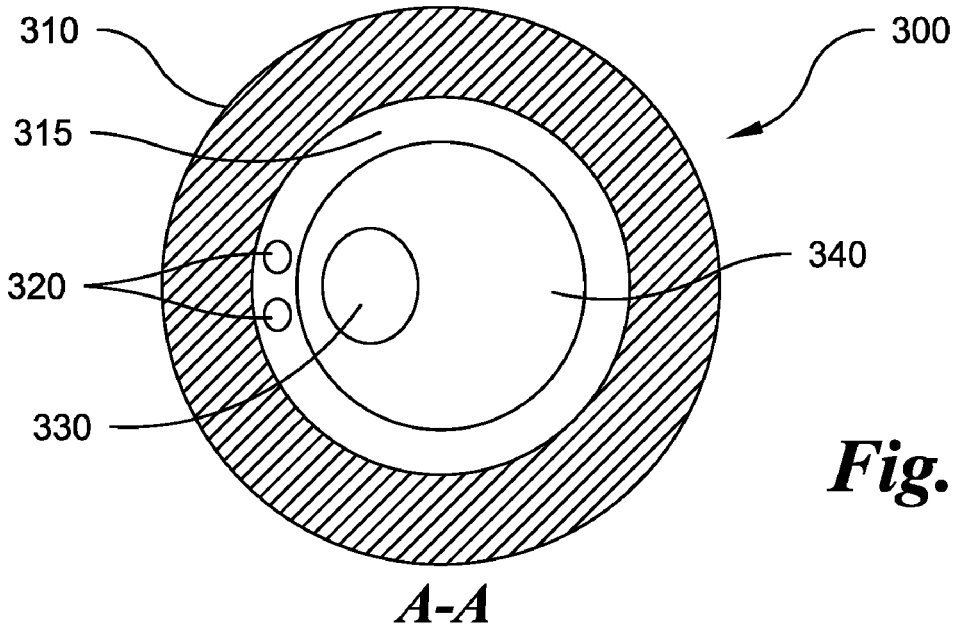
FIG. 3*b* illustrates a cross section along lines A-A of the buoyant cable of FIG. 3*a* according to an embodiment of the invention.

As shown in FIG. 3*a*, there is provided a cable 300 that provides a direct point-to-point connection between an unsubmerged or surface object at location X and a submerged object at location Y. As shown in FIG. 3*a* and FIG. 3*b*, one embodiment of the invention includes a cable 300 comprised of four components: another sheath-like layer or jacket 310, communication conduit 315, a data transmission line 320 and a location-measuring device line 330. The device 330 is capable of providing optical, magnetic or electronic data useful in the determination of the distance between the connection at points X and Y (i.e., between the surface object and the submerged object).

Cable 300 and associated components have a combined density that is equal to or less than the water in which it is submerged; i.e., the specific gravity is equal to or less than one so that it will not sink in water. The specific gravity of the cable is a function of (1) cable material selection, (2) cable coatings, and (3) molding of a sheath and the components (location device, communication lines) within the cable. However, the buoyancy of the cable 300 contributes substantially to no load or tension on either the submerged device at location Y or the unsubmerged device at location X. As indicated, the density and hence the specific gravity of the cable 300 is controlled by means of material selection, coatings or molding of the sheath 310 as well as the utilization of the cable conduit space 315 and space 340, which may be either evacuated of air or filled with gases or materials that tailor the specific gravity of the cable 300 into a region where it essentially floats in the water in which it is submerged. The evacuation of air or filling with gases of the space 315 and space 340 may be done on a permanent basis or dynamically dependent on water conditions, such as water density or temperature. Sheath 310 is fabricated from a resilient material such as engineered materials, metals or plastics or a combination thereof. The transmission line 320 communicates data to and from the unsubmerged device using any one of several technologies, such as wire or fiber optics.

With reference to FIG. 2, the on-board interface line location processor 212 receives the cable 216 location data (x, y and z) from the fiber optics location measurement device 215 and GPS position 205 data from the GPS device 218. The submerged vessel 210 such as a submarine in-board end or the proximal end of the cable 216 is split so that fiber optic location measuring device 215 connects to location processing equipment, such as by way of example and not limitation, fiber optic line location processor 212 and the transmission line 217 that connects to the GPS receiver 213.

The navigation processor 214 receives data input from location processor 212 and GPS receiver 213 and processes the data utilizing algorithms to determine substantially the endpoint of the cable 216. The navigation processor 214 then outputs the submerged vessel 210 position and velocity in real time. These algorithms use the fiber optics location device 215 data for each detected strain in the fiber (each representing a bend location in the device 215 and hence a bend in the collocated cable 216). The physical and mathematical considerations for the development of algorithms to determine the shape and hence location of device 215 is well known to those of ordinary skill in art of electrical engineering referencing Childers, US. Pub. 20070065077, the subject matter thereof incorporated by reference herein in its entirety. Once the location of device 215 is ascertained, the mathematical considerations for the development of algorithms to determine position of the submerged vessel based upon the GPS position 205 and the location of location device 215 relative to the submerged vessel 210 and the GPS device 218 are well known to those of ordinary skill in art of electrical engineering. In certain applications, there might be a delayed output from navigation processor 214 while the computer uses position difference and smoothing to improve overall computation accuracy.

Figure 4:
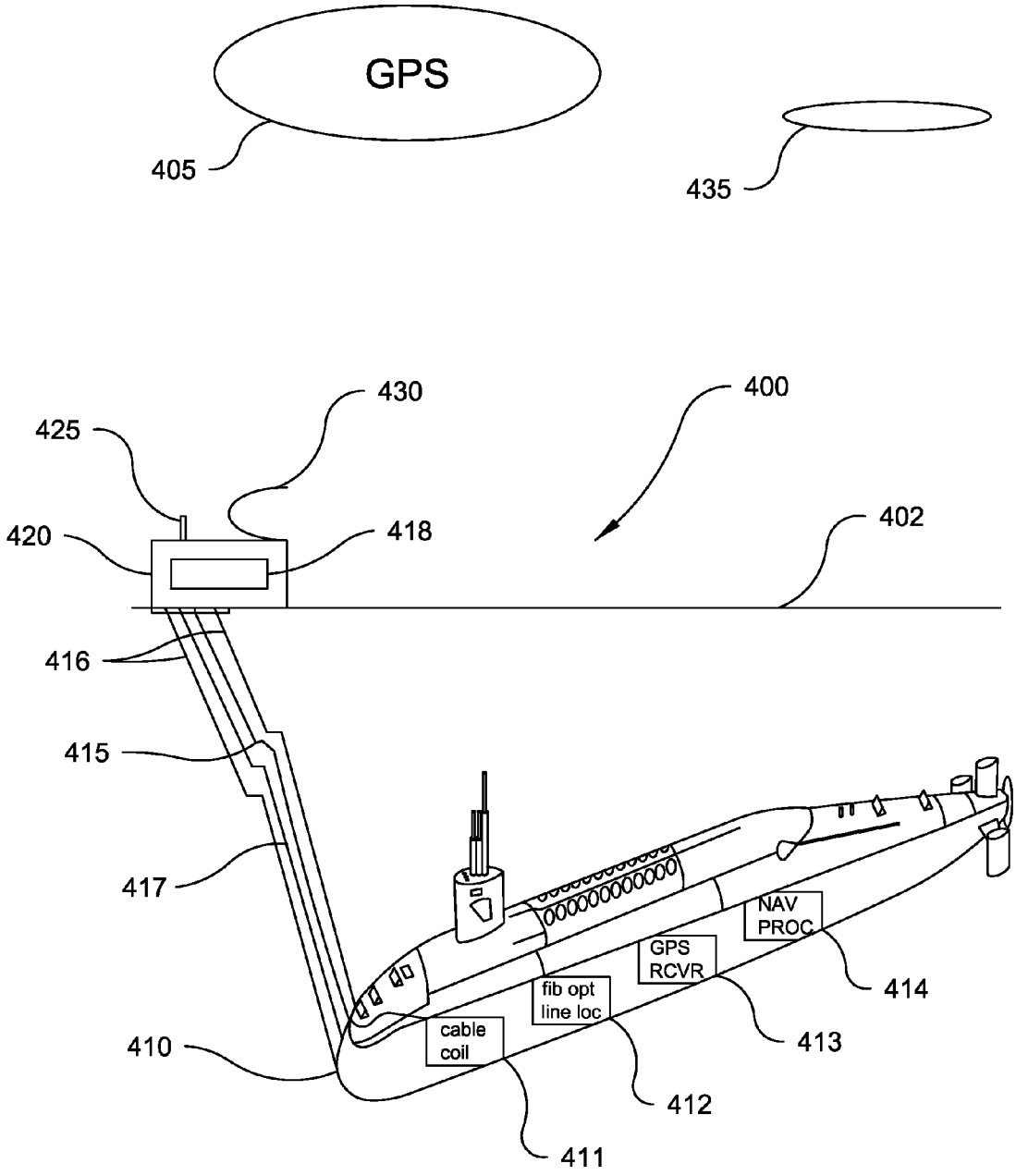
FIG. 4 illustrates a perspective view of a non-acoustic covert means to provide navigation information to a submerged vessel for application to systems on the surface of a body of water according to an embodiment of the invention.

FIG. 4 illustrates as one embodiment of the invention a perspective view of non-acoustic covert system 400 comprising: a submerged vessel 410 having thereon a navigation processor 414; a buoy 420 having thereon a GPS device 418 and one of a radio communication, radar or optical surveillance device 430; a cable 416 that couples the navigation processor 414 with the buoy 420; wherein the cable 416 contains (a) a conductive wire and/or a fiber optic transmission line 417 between the vessel and the GPS device 418 for communicating GPS data to the processor 414 and (b) a location device 415 for aiding in the determination of the location of the cable to the navigation processor 414; and wherein the processor 414 computes a GPS position relative to the submerged vessel 410 based on the received GPS data and the location device 415 data. Note that location device 415, cable 416 and transmission line 417 are analogous to FIG. 2 location device 215, cable 216 and transmission line 217.

In the embodiment shown in FIG. 4, the submerged vessel 410 has a communication or surveillance mission utilizing, by way of example and not limitation, one of a radio communication, radar or optical surveillance device 418 having one of an antenna or optical system 430, respectively. By way of example, the surveillance device 418 communicates with the submerged vessel 410 via cable 416 communication link as described in connection with cable 216, FIG. 2. The position of a target relative to the buoy or platform 420 is determined via GPS as received via antenna 425 and further as described in connection with GPS device 218, FIG. 2. The actual position of the buoy or platform 420 is determined from the location measurement device 415 as described in connection with device 215, FIG. 2. In another embodiment of the invention, the submerged vessel 410 has an offensive or defensive mission whereby independent or in association with the surveillance mission, fire control armament or missile weaponry are directed to a target 435. In yet another embodiment, the submerged vessel 410 utilizes a device represented by device 418 as an electronic countermeasure system against target 435.

The invention herein also includes a navigation process comprising the steps of: (1) attaching a cable between a buoy and a submerged vessel; (2) providing GPS data relative to the buoy and cable location data over the cable to the submerged vessel; and (3) using the GPS position of the buoy and location data to compute the GPS position of the submerged vessel. More particularly, in accordance with FIG. 5, a GPS navigation process 500 comprises: attaching 510 a buoyant cable between a buoy and a submerged vessel; providing 515 a communication GPS data link providing GPS data relative to the buoy and cable location via a location device within the buoyant cable; communicating 520 GPS position data of the buoy and the location of the cable via the buoyant cable to the submerged vessel; and using the GPS position of the buoy and data from the location device to compute the GPS position 525 of the submerged vessel. In another embodiment of the process 500 the navigation process further includes the steps of: (a) coupling a navigation processor with the buoy; (b) determining of the location of the buoy relative to the submerged vessel and (c) computing a GPS position relative to the submerged vessel based on received GPS data and location device data.

Figure 5:
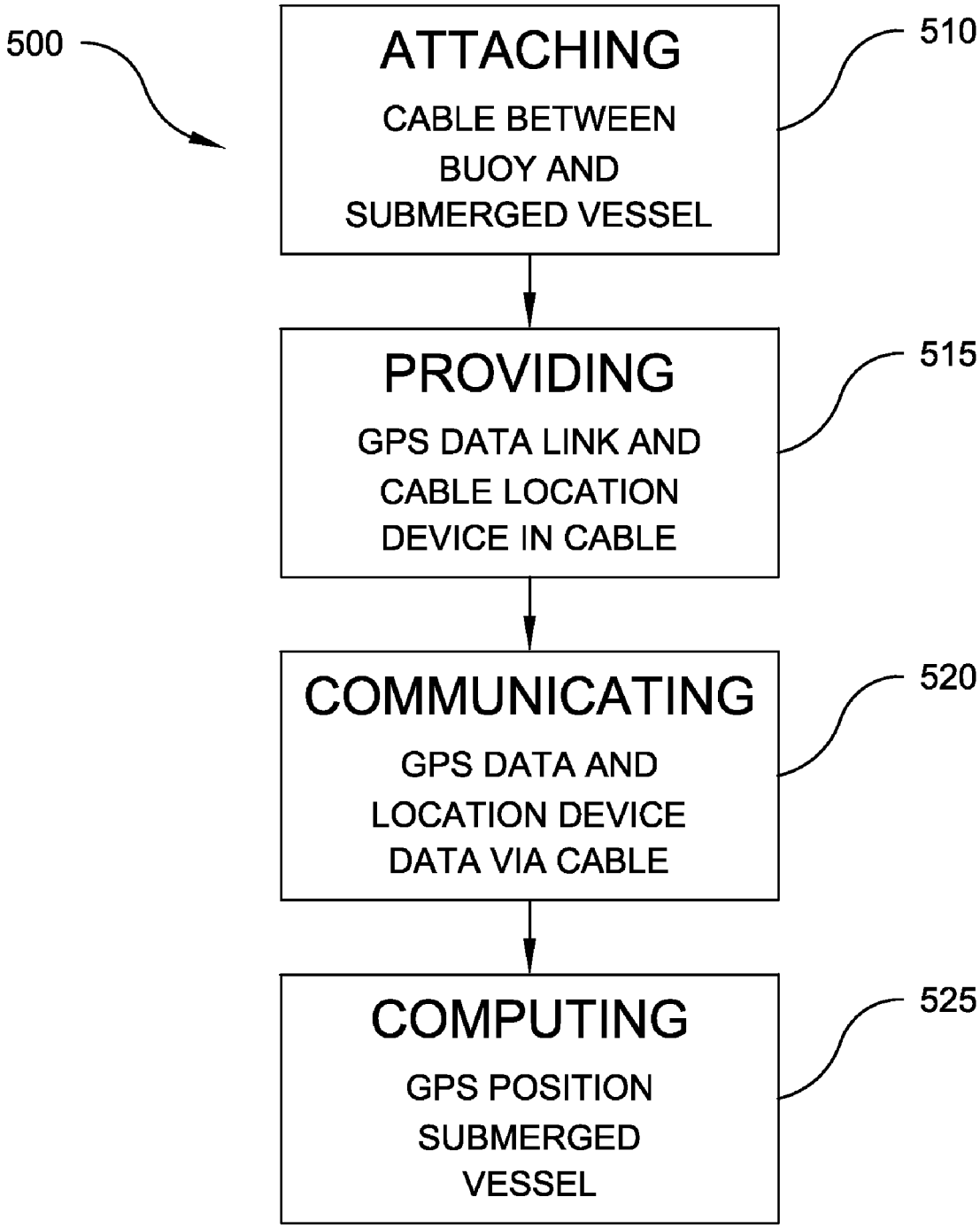
FIG. 5 is a flow chart of a process according to an embodiment of the invention.

With reference to FIG. 2, FIG. 4 and FIG. 5 it is understood that the processing and associated processors used in computing the true distance measurement between an object on the surface of a body of water 202 and an object such as submerged vessel 210 in the water 202 can be implemented in hardware, software, firmware, or combinations thereof. Having one or more GPS locations and associated time intervals allows a calculation of the true velocity of the submerged vessel 210. It is also to be appreciated that, where the functionality selection is implemented in either software, firmware, or both, the processing instructions can be stored and transported on any computer-readable medium for use by or in connection with an instruction execution system, apparatus, or device, such as a computer-based system, processor-containing system, or other system that can fetch the instructions from the instruction execution system, apparatus, or device and execute the instructions. Generally the software processes may exist in a variety of forms having elements that are more or less active or passive. For example, they may exist as software program(s) comprised of program instructions in source code or object code, executable code or other formats. Any of the above may be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), flash memory, and magnetic or optical disks or tapes. Exemplary computer readable signals are signals that a computer system hosting or running the computer program may be configured to access, including signals downloaded through the Internet or other networks. Examples of the foregoing include distribution of the program(s) on a CD ROM or via Internet download.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A navigation system comprising:

a submersible vessel having thereon a navigation processor;

a buoy having thereon a GPS device;

a cable that couples the navigation processor with the buoy;

wherein the cable contains (a) a data link between the vessel and the GPS device for communicating GPS data to the processor and (b) a location device for aiding in the determination of the location of the cable to the submersible vessel; and wherein the processor computes a GPS position relative to the submersible vessel based on the received GPS data and the location device data.

2. The navigation system of claim 1, wherein the cable is buoyant.

3. The navigation system of claim 2, wherein the buoyancy of the cable contributes substantially no tension between the submersible device or the buoy.

4. The navigation system of claim 1, wherein the location device is a smart fiber cable that measures physical coordinates along its length.

5. The navigation system of claim 4, wherein physical coordinates are employed to compute a distance between the submersible vessel and the buoy.

6. The navigation system of claim 1, wherein the length of the location device is the same length as the cable.

7. The navigation system of claim 1, wherein the data link comprises one of a conductive wire; and a fiber optic transmission line that sends GPS position data as acquired from the GPS device to a receiver within the submersible vessel.

8. The navigation system of claim 1, wherein a location device processor receives the data from the measuring device to provide location data to the navigation processor.

9. The navigation system of claim 8, wherein the navigation processor employs data from the location device processor to compute the location of the buoy relative to the submersible vessel.

10. The navigation system of claim 1, wherein the navigation processor computes the velocity of the submersible vessel based on the received GPS data and the location device data.

11. The navigation system of claim 1, further including a deployment system for uncoiling of the cable.

12. The navigation system of claim 1, further including a retraction system for recoiling of the cable.

13. The navigation system of claim 1, wherein the cable provides a direct point-to-point connection between a surface object and a submersible object.

14. The navigation system of claim 1, wherein the cable includes a data transmission line and a location-measuring device line.

15. The navigation system of claim 1, wherein the location device is capable of providing one of optical, magnetic, and electronic data useful in the determination of the distance between the vessel and the GPS device.

16. The navigation system of claim 1, wherein the cable density is equal to or less than the water in which it is submerged.

17. The navigation system of claim 1, wherein the specific gravity of the cable is equal to or less than one.

18. The navigation system of claim 17, wherein the specific gravity of the cable is controlled by cable conduit space.

19. The navigation system of claim 18, wherein the conduit space is one of an evacuated space, a gas filled space; and a materials filled space to tailor the specific gravity of the cable.

20. The navigation system of claim 18, wherein the specific gravity of the cable is set on a permanent basis or set dynamically dependent on water conditions.

21. The navigation system of claim 17, wherein the specific gravity of the cable is a function of at least one of cable material selection, cable coatings; and sheath molding.

22. The navigation system of claim 21, wherein a cable sheath is fabricated from a resilient material.

23. The navigation system of claim 1, wherein the navigation processor outputs submersible vessel position and velocity in real time.

24. The navigation system of claim 1, wherein the submersible vessel further includes:

a GPS receiver; and a location device processor;

wherein said GPS receiver and said location device processor are onboard said submersible vessel; and wherein the GPS data is communicated from said GPS device on the buoy to the navigation processor via said GPS receiver.

25. A non-acoustic covert system comprising:

a submersible vessel having thereon a navigation processor;

a buoy having thereon a GPS device and one of a radio communication, radar or optical surveillance device;

a cable that couples the navigation processor with the buoy;

wherein the cable contains (a) a data link between the vessel and the GPS device for communicating GPS data to the processor and (b) a location device for aiding in the determination of the location of the cable to the navigation processor; and wherein the processor computes a GPS position relative to the submersible vessel based on the received GPS data and the location device data.

26. The non-acoustic covert system of claim 25, wherein said one of said radio communication, and radar includes an antenna for transmitting and receiving.

27. The non-acoustic covert system of claim 25, wherein said optical surveillance device includes an optical system for receiving optical input.

28. The non-acoustic covert system of claim 25, wherein the submersible vessel further includes:

a GPS receiver; and a location device processor;

wherein said GPS receiver and said location device processor are onboard said submersible vessel; and wherein the GPS data is communicated from said GPS device on the buoy to the navigation processor via said GPS receiver.

29. A navigation process comprising the steps of:

attaching a cable between a buoy and a submersible vessel;

providing GPS data relative to the buoy and cable location data over the cable to the submersible vessel; and using the GPS position of the buoy and location data to compute the GPS position of the submersible vessel.

30. The navigation process of claim 29, further including the step of coupling a navigation processor with the buoy.

31. The navigation process of claim 29, further including the step of determining the location of the buoy relative to the submersible vessel.

32. The navigation process of claim 29, further including the step of computing a GPS position relative to the submersible vessel based on received GPS data and location device data.

* * * * *